United States Patent [19]

Crawford

[11] Patent Number: 4,685,403

[45] Date of Patent: Aug. 11, 1987

[54] AUXILIARY INCINERATOR APPARATUS

[76] Inventor: James P. Crawford, P.O. Box 13243, Orlando, Fla. 32859

[21] Appl. No.: 939,088

[22] Filed: Dec. 8, 1986

[51] Int. Cl.[4] ..... F23G 1/00

[52] U.S. Cl. ..... 110/194; 110/235

[58] Field of Search ..... 110/235, 194, 210; 432/167, 163

[56] References Cited

U.S. PATENT DOCUMENTS 1,421,919 7/1922 Davidson et al. ..... 110/194

3,446,163 5/1969 Sharpe ..... 110/235

*Primary Examiner*—Edward G. Favors

[57] ABSTRACT

An auxiliary incinerator apparatus for a crematory includes a main incinerator having primary and secondary chambers formed with a plurality of refractory walls and a main door into the primary chamber. The main incinerator has an outer framework with wall attached thereto and spaced from the refractory walls. The refractory passageway extends from the primary chamber refractory wall to the outer wall. An auxiliary incinerator is attached to the side of the main incinerator outer wall and framework, adjacent to the opening from the refractory passageway through the wall. The auxiliary incinerator has an incineration chamber formed therein with a top opening thereinto. An auxiliary door simultaneously opens and closes over the opening from the refractory passageway through the outer wall and over the opening into the auxiliary incinerator, so that partially incinerated materials can be moved from the main incinerator to the auxiliary incinerator for further combustion. A second door into the auxiliary incinerator allows for the removal of ashes.

15 Claims, 10 Drawing Figures

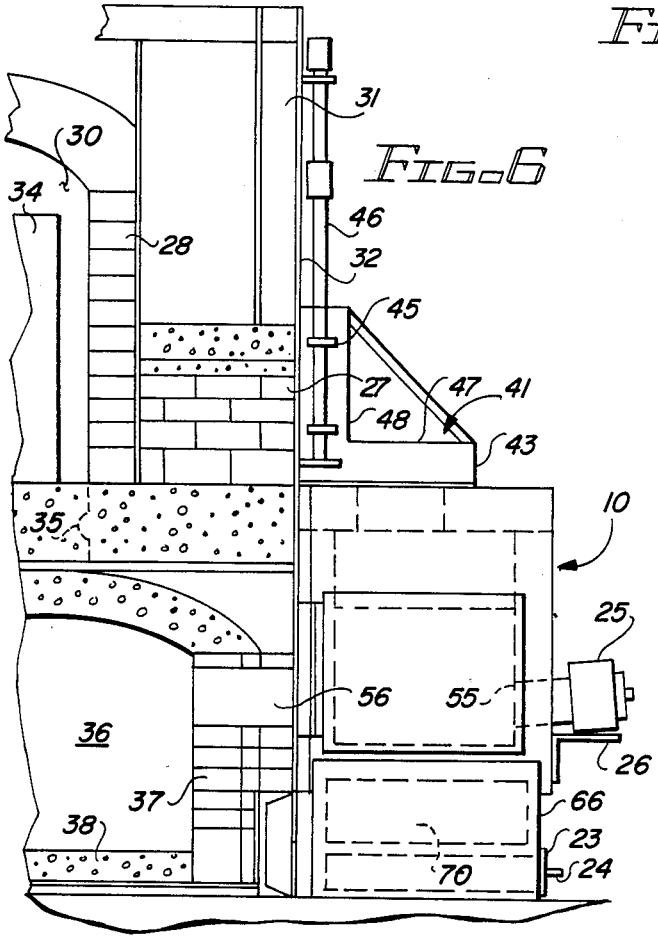
FIG. 6
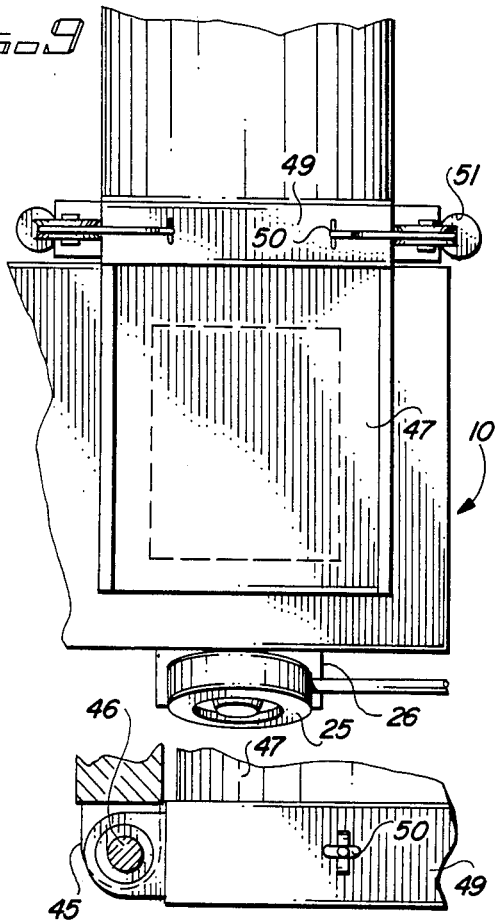
FIG. 9
FIG. 10
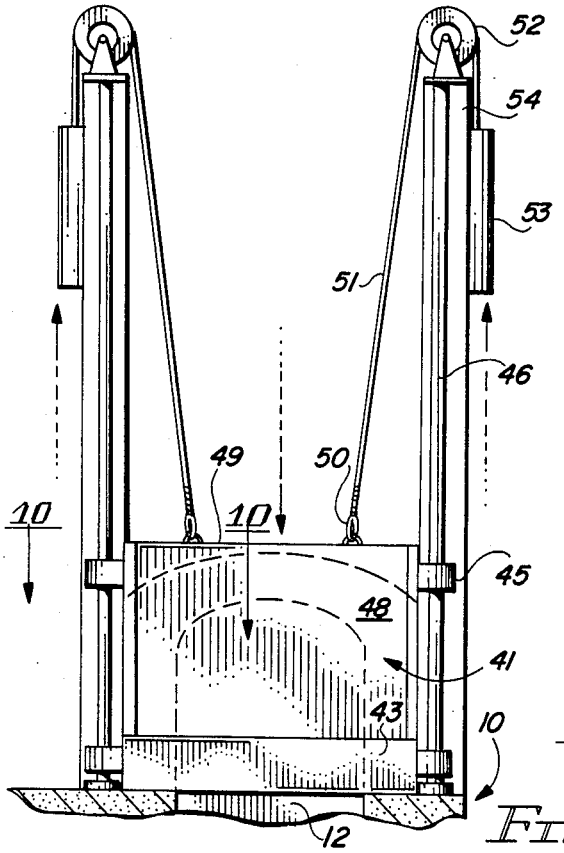
FIG. 7
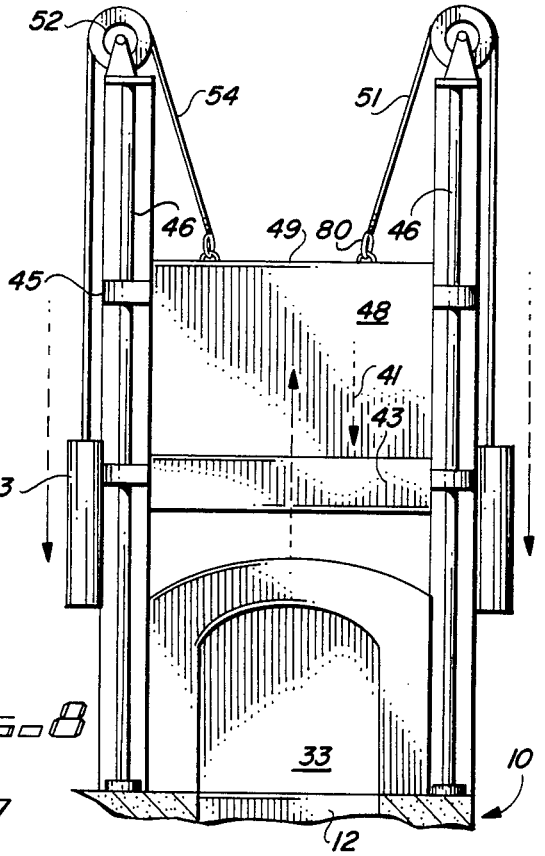
FIG. 8

AUXILIARY INCINERATOR APPARATUS

BACKGROUND OF THE INVENTION

The present application relates to an auxiliary incinerator for crematories, and especially to an auxiliary crematory for operating in conjunction with a primary crematory.

In the past, there have been a wide variety of incinerators, including, various crematories used for cremating both human and animal remains. The prior art crematories typically have a secondary chamber and a primary chamber having an entrance doorway thereinto. Crematories are typically lined with refractory materials and allow for an input directly into the primary chamber through a refractory lined door. A gas burner typically heats the crematory for a period of time prior to the beginning of a cremation. A second door into the primary chambers is typically placed at the back of the primary chamber for the removal of remains. The remains are typically raked out manually and pulled over a ledge at one end of the crematory primary chamber. The remains may then be further processed to produce a fine ash. Crematories typically have a single gas burner and air input and an exhaust therefrom. Prior art crematories can be seen in the following U.S. Patents.

| | |
|---|---|
| E. I. Staples | U.S. Pat. No. 1,952,389 |
| Albertson | U.S. Pat. No. 4,257,335 |
| William W. Segrest | U.S. Pat. No. 4,321,878 |
| William W. Segrest | U.S. Pat. No. 3,538,864 |
| Kjell Falling | U.S. Pat. No. 3,874,310 |
| L. S. Martin | U.S. Pat. No. 3,176,634 |
| C. A. DeLong, et al. | U.S. Pat. No. 2,294,390 |
| William O. Segrest | U.S. Pat. No. 4,401,038 |
| Kjell Falling | U.S. Pat. No. 3,874,310 |
| Kjell Falling | U.S. Pat. No. 3,837,301 |

Even with primary and secondary chambers, the crematory process can be a time consuming one. The present invention is specially for reducing the amount of time to perform a cremation by adding an auxiliary incinerator to the side of the main incinerator to allow the partially cremated remains to be raked out a side passageway into the auxiliary incinerator and then further incinerated, while a second incineration is taking place in the primary chamber. Once the auxiliary cremation is completed, the remains can be raked into an attached processor for comminuting the remains which are deposited into a finished remains drawer from which they can be transferred to final resting place. An auxiliary crematory utilizes a combined door for opening the side passageway into the primary chamber of the main incinerator and for opening an opening into the top of the auxiliary incinerator. The auxiliary incinerator utilizes its own burner, but directs the exhaust into the secondary chamber of the main incinerator for exhaust with the incinerator exhaust.

SUMMARY OF THE INVENTION

The present invention relates to an auxiliary incinerator apparatus for an incinerator which has a main incinerator having a primary and secondary chambers formed with a plurality of refractory walls. The main incinerator has a main door into the primary chamber and also has an outer framework and walls spaced from the refractory walls. One of the main incinerator refractory walls has an opening therethrough and a refractory passageway extends from the opening in the main incinerator wall to the outer wall and has an opening through the outer wall. An auxiliary incinerator having its own burner and a refractory lined wall is attached to one side of the main incinerator adjacent to the opening from the refractory passageway through the outer wall and has an opening in the top thereof into the incineration chamber. An auxiliary door is mounted to the framework of the main incinerator for opening and closing the opening from the refractory passageway through the outer wall and for opening and closing the opening into the auxiliary incinerator simultaneously. This auxiliary door can slide on a track and can be counter-balanced to help support the refractory material formed into the door. The auxiliary incinerator can have a removal refractory door which opens and allows the raising of a lid into a final comminutor so that the lid folds over to form a chute for the remains from the auxiliary incinerator. The auxiliary incinerator has an exhaust connection to the secondary chamber of the main incinerator.

BRIEF DESCRIPTION OF THE DRAWINGS

Other objects, features and advantages of the present invention will be apparent from the written description and the drawings in which:

FIG. 6 is a sectional view taken on line 6—6 of FIG. 1;

FIG. 7 is a side elevation of the door of FIG. 2 in a closed position;

FIG. 8 is a side elevation of the door of FIG. 7 in an open position;

FIG. 9 is a top elevation of the door of FIGS. 7 and 8; and

FIG. 10 is a sectional view taken on line 10—10 of FIG. 7.

DESCRIPTION OF THE PREFERRED EMBODIMENT

Figure 1:
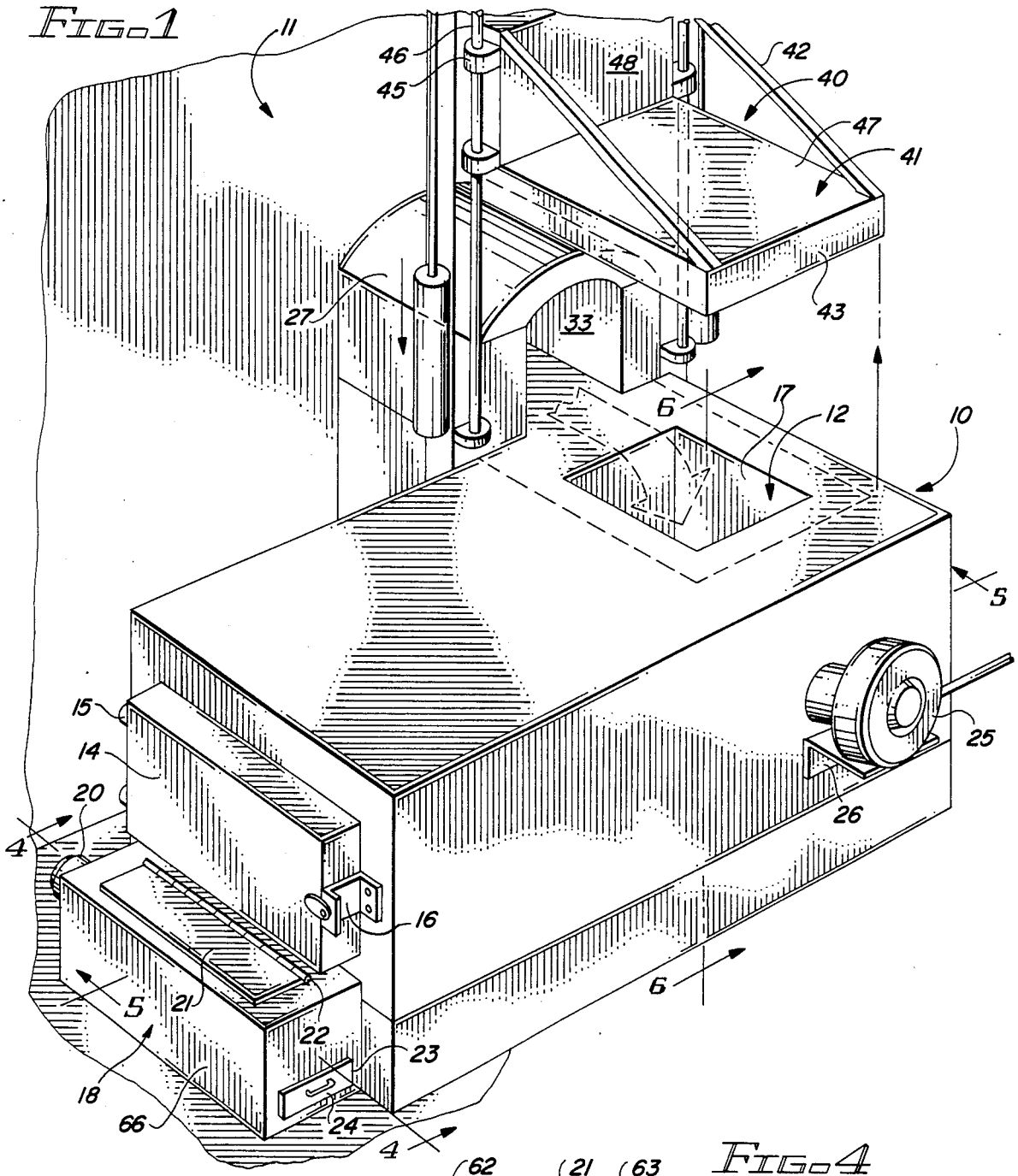
FIG. 1 is a perspective view of an auxiliary incinerator in accordance with the present invention.

Referring to FIGS. 1 through 10 of the drawings, an auxiliary incinerator 10 is seen attached to an incinerator 11. The auxiliary incinerator 10 has a top 11 having an entrance or opening 12, a side 13, along with an exit door 14. The exit door 14 is hinged at 15 and latched which a latching mechanism 16 and is refractory lined. The opening 12 can be seen to have a refractory lining 17 in the auxiliary incinerator. A processor or comminutor 18 is attached adjacent the door 14 to the auxiliary incinerator 10 and has an electric motor 20 on one end thereof along with a hinged lid chute 21 hinged with a hinge 22 and having a final remains drawer 23 with a handle 24. A gas burner 25 is mounted with a bracket 26 welded to the side 13 of the auxiliary incinerator 10. An auxiliary passageway 27 is made of a refractory material and extends from the refractory wall 28 of the primary chamber 30 of the main incinerator 11 past the outer framework 31 and through the outer wall 32, and has an opening 33 extending through the outer wall. The passageway extends also through the refractory wall 28 into the chamber 30. The primary chamber 30 can be seen having a door 34 in FIG. 6 for the insertion of materials to be incinerated, and a floor 35 for supporting materials in the primary chamber 30. The secondary chamber 36 is located directly beneath the primary chamber 30 and also has refractory walls 37 and a refractory base 38. The openings 12 and 33 have a single door 40 formed of a refractory material 41 having braces 42 mounted to the steel framework 43 which has support brackets 45 formed onto the steel framework sliding on cylindrical steel tracks 46. The door 40 is L-shaped having a horizontal extending portion 47 and a vertically extending portion 48. The vertically extending portion 48 has a pair of eyes 50 having flexible cables 51 attached thereto and extending over a pair of pulleys 52 and connected to counter-balancing weights 53. The pulleys 52 are attached to frame members 54. The counter-weights 53 allow the heavy door 40 containing refractory material to be more easily raised and lowered to close the opening 33 and 12. When the door is closed, as shown in FIG. 7, the door closes the opening 33 with the vertical portion 48, while the horizontal portion 47 closes the opening 12 into the auxiliary incinerator. Thus, the door 40 can be raised and an individual can rake partially cremated remains from the primary chamber 30 through the passageway 27 into the top opening 12 and then the door 40 lowered to close off both openings 17 and 33. The auxiliary incinerator 10 can be seen as having a burner inlet 55 extending thereto from the gas burner 25 and an exhaust outlet 56 extending through the refractory wall 37, as well as through the outer wall 31 and into the secondary chamber 36 of the main incinerator 11. This allows the exhaust gases from the auxiliary incinerator 10 to be passed out the exhaust for the main incinerator 11.

Figure 4:
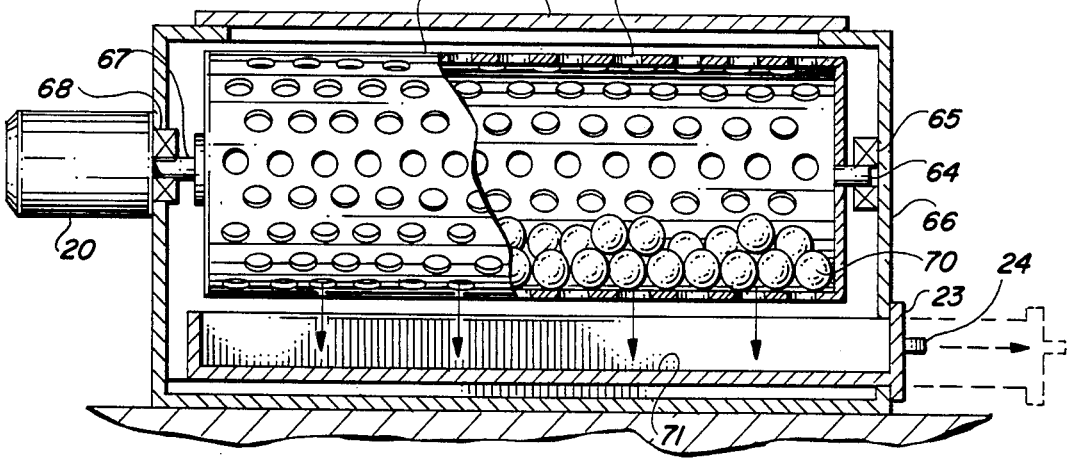
FIG. 4 is a sectional view taken on line 4—4 of FIG. 1.
Figure 2:
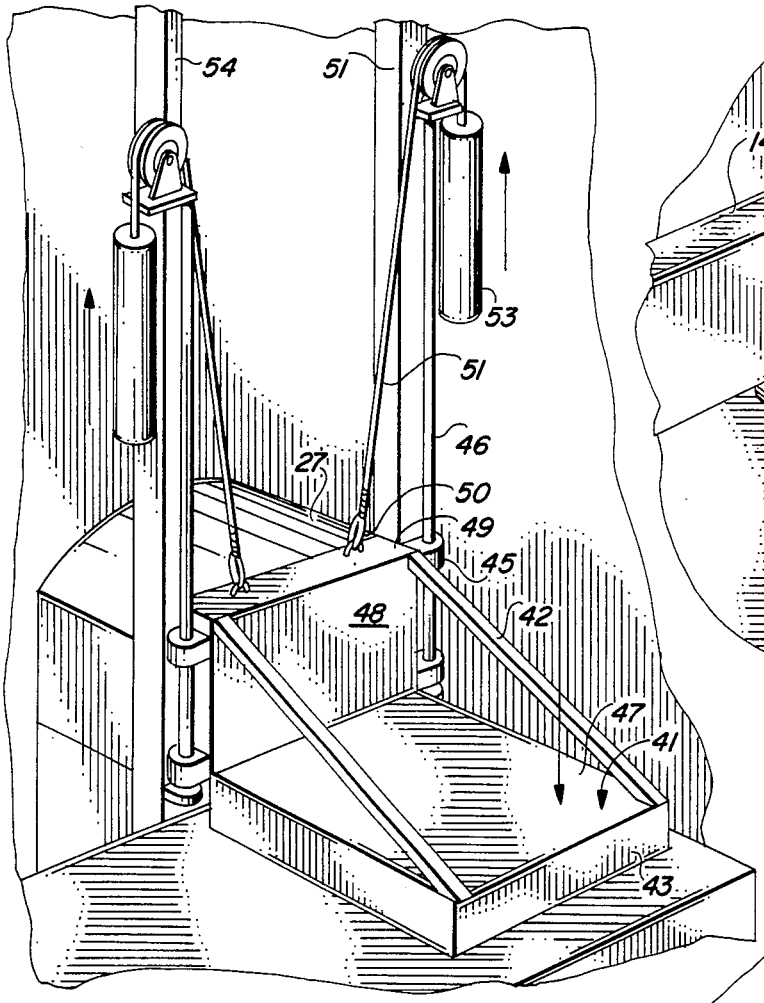
FIG. 2 is a perspective view of the auxiliary door for the auxiliary incinerator.
Figure 3:
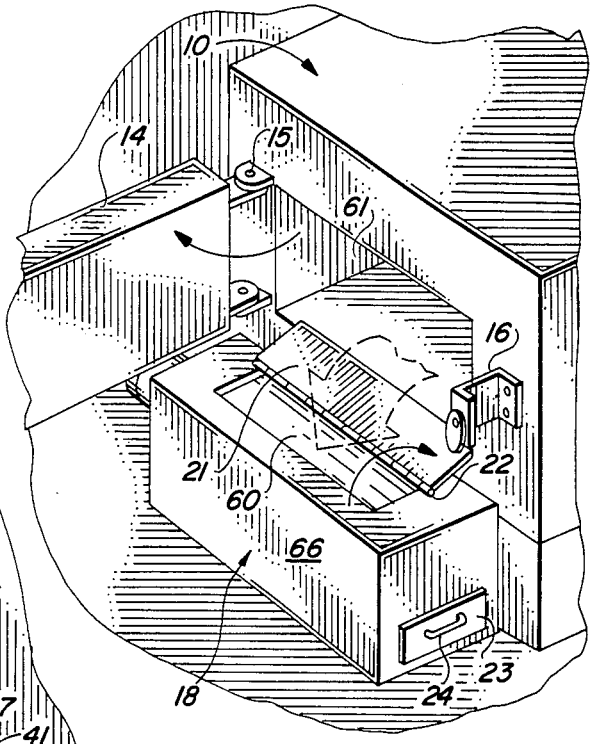
FIG. 3 is a partial perspective of an auxiliary incinerator door and chute for the final comminutor.
Figure 5:
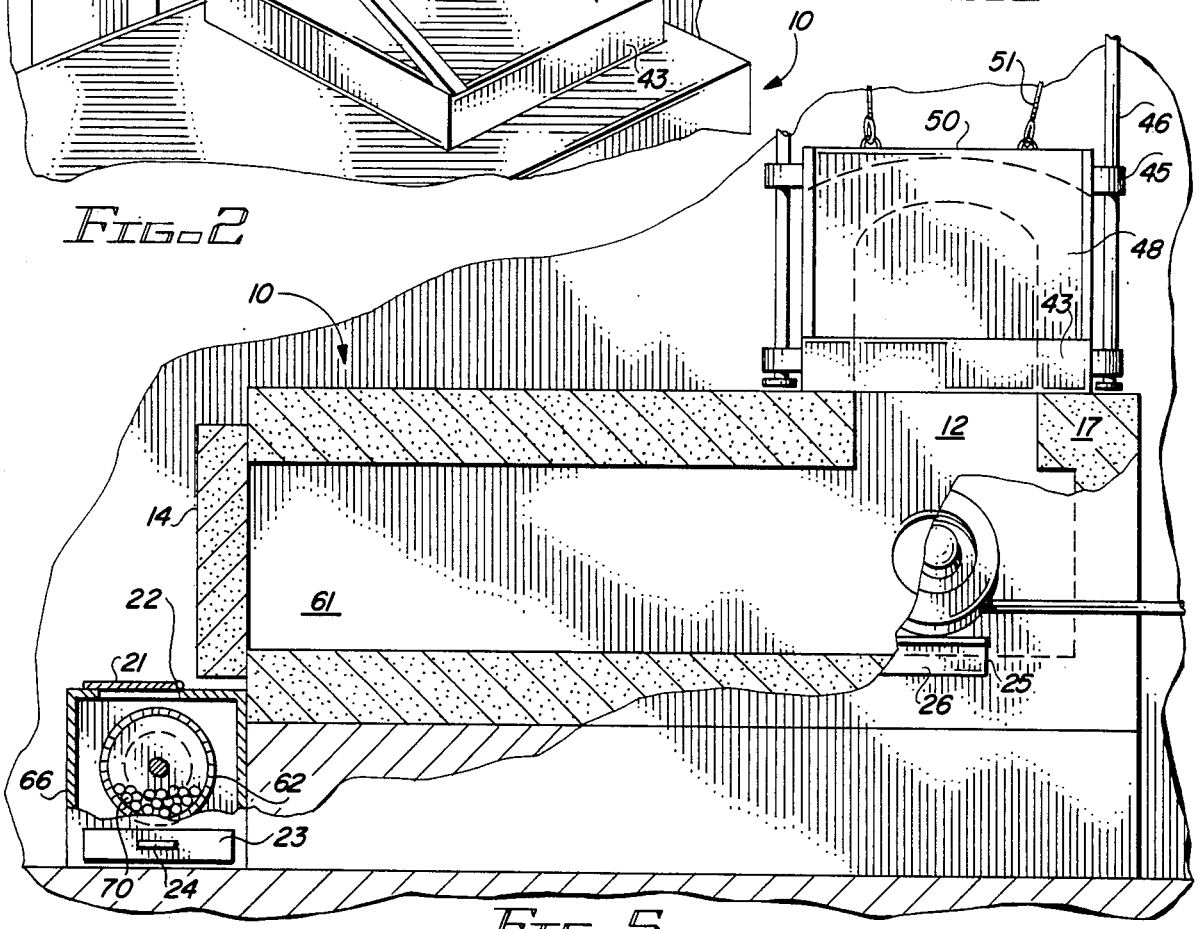
FIG. 5 is a sectional view taken on line 5—5 of FIG. 1.

Referring more specifically to FIGS. 3 and 4, the auxiliary incinerator exit door 14 is shown in an open position so that the lid 21 of a comminutor 18 can be raised as shown to FIG. 3 to form a chute into an opening 60. The chute allows ashes or remains to be raked from the auxiliary incinerator 10, chamber 61, across the lid chute 21 into the opening 60 which contains a rotating cage 62 with a large number of openings 63 therein. The shaft 64 is attached to one end of the cage 62 and rides on a bearing 65 mounted to the side wall 66 of the processor 18. A shaft 67 is attached to the other end of the cage 62 and rides on a bearing 68 and is attached to the shaft of an electric motor 20. A plurality of steel balls 70 ride in the cage 62. The rotating of the cage 62 with the openings 63 therein and the constant agitation of the steel balls 70, acts to break up the ashes of the remains being raked from the auxiliary incinerator 10, chamber 61 thereinto. Ashes then drop into the drawer container 71 so that the drawer 23 can be removed with the handle 24 and placed in a separate container.

In operation as a creamating device, the last remains can be placed through the door 34 in FIG. 6 into the primary chamber 30, which has been preheated by a gas burner producing heat from gas and air being fed thereinto. However, inasmuch as it takes an undue amount of time for a cremation without the use of direct flame in the last stages of the cremation, the process is speeded up for a small crematory, by removing the partially cremated remains from the primary chamber 60 through the passageway 27, manually with a hand raking tool after the door 40 has been raised so that the partial remains can be raked directly into the opening 12 of the auxiliary incinerator. The door 40 can then be lowered to close off the opening 33 and the opening 12. The auxiliary incinerator continues under its own heat from the burner 25. When the cremation is complete, the door 14 can be opened, the lid 21 raised to form a chute and the manual raking tool used to rake the remains into the final processing comminutor 18, which is rotated rapidly to break up final ashes and to drop them into the base 71 of the drawer 23.

This then allows the door 40 to be reopened and partial remains moved into the auxiliary incinerator 10 so that the next remains can be placed in the primary chamber of the main incinerator.

It should be clear at this point that an auxiliary incinerator for a primary crematory having primary and secondary chambers, which are refractory lined, has been provided. The auxiliary crematory can be added to existing crematories, but requires the modification of the side of the existing crematory for adding the extending refractory passageway and for adding the exhaust from the auxiliary crematory back into the secondary chamber of the main crematory. Once attached, the time required for performing a series of cremations, is greatly reduced without the adding of additional and expensive incineration equipment.

However, the present invention should not be considered limited to the forms shown, which are to be considered illustrative rather than restrictive.

I claim:

1. An auxiliary incinerator apparatus for an incinerator comprising:

a main incinerator having primary and secondary chambers formed with a plurality of refractory walls, said main incinerator having a main door into the primary chamber, and said main incinerator having an outer framework and walls spaced from the refractory walls, and one refractory wall having an opening therethrough;

a refractory passageway extending from said opening in said main incinerator wall to the outer wall and having an opening through said outer wall;

an auxiliary incinerator attached to one side of the main incinerator adjacent to said opening from said refractory passageway through said outer wall, said auxiliary incinerator having an incineration chamber formed therein with an opening thereinto; and auxiliary door means for opening and closing over said opening from said refractory passageway through said outer wall and for opening and closing over the opening into said auxiliary incinerator, whereby partially incinerated materials can be moved from the main incinerator to the auxiliary incinerator for further combustion.

2. An auxiliary incinerator apparatus in accordance with claim 1 in which said auxiliary incinerator includes an exhaust extending from said auxiliary incinerator incineration chamber into said main incinerator.

3. An auxiliary incinerator apparatus in accordance with claim 2 in which said auxiliary incinerator has an auxiliary incinerator burner attached to one side thereof.

4. An auxiliary incinerator apparatus in accordance with claim 3 in which said auxiliary incinerator burner is connected through one wall thereof for directing the incinerator flame into said auxiliary incinerator incineration chamber.

5. An auxiliary incinerator apparatus in accordance with claim 4 in which said auxiliary incinerator burner is supported on a bracket attached to one side of said auxiliary incinerator.

6. An auxiliary incinerator apparatus in accordance with claim 1 in which said auxiliary incinerator has an exit door over one end thereof and includes a ashes disintegrator mounted adjacent thereto.

7. An auxiliary incinerator apparatus in accordance with claim 6 in which said ashes disintegrator has a door hinged on a hinge along one edge thereof and having a predetermined shape to lay against the edge of said auxiliary incinerator incineration chamber exit for forming a chute from said auxiliary incineration chamber into said disintegrator.

8. An auxiliary incinerator apparatus in accordance with claim 7 in which said asshes disintegrator has a rotating cage rotated by an electric motor and holding a plurality of steel balls therein, and said cage has a plurality of openings therethrough, and said ashes disintegrator has a removable drawer mounted therebeneath.

9. An auxiliary incinerator apparatus in accordance with claim 1 in which said auxiliary door means includes refractory materials formed thereon for covering said openings in said refractory passageway and in said auxiliary incinerator.

10. An auxiliary incinerator apparatus in accordance with claim 9 in which said auxiliary door means includes counterbalancing means for counterbalancing said auxiliary door means.

11. An auxiliary incinerator apparatus in accordance with claim 10 in which said auxiliary door means has an L-shaped door having refractory material mounted thereto.

12. An auxiliary incinerator apparatus in accordance with claim 11 in which said auxiliary door means includes a pair of slide railings having two shafts attached to said main incinerator outer framework and said auxiliary door means door has a steel framework having four brackets sliding on said shafts.

13. An auxiliary incinerator apparatus in accordance with claim 12 in which said slide railings each have a pulley mounted thereto with a cable attached to the metal framework of said auxiliary door means door and extending over each pulley and attached to a counterbalancing weight.

14. An auxiliary incinerator apparatus in accordance with claim 13 in which said auxiliary door means door metal framework includes a pair of steel support braces extending between the framework on the end of each side of said L-shaped door.

15. An auxiliary incinerator apparatus in accordance with claim 1 in which said auxiliary incinerator includes an exhaust connecting said incineration chamber to said main incinerator secondary chamber for recycling exhaust heat through said main incinerator.

* * * * *